US005533790A

United States Patent [19]

Weiland

[11] Patent Number: 5,533,790

[45] Date of Patent: Jul. 9, 1996

[54] FLOOR MILLING MACHINES

[75] Inventor: Raymond F. Weiland, 63 Astley Street, Lower Templestowe, Victoria 3107, Australia

[73] Assignees: Raymond F. Weiland; Pamela Weiland, both of Lower Templestowe, Australia

[21] Appl. No.: 232,107

[22] PCT Filed: Oct. 22, 1992

[86] PCT No.: PCT/AU92/00569

§ 371 Date: Jul. 11, 1994

§ 102(e) Date: Jul. 11, 1994

[87] PCT Pub. No.: WO93/08003

PCT Pub. Date: Apr. 29, 1993

[30] Foreign Application Priority Data

Oct. 22, 1991 [AU] Australia ..... PK9046

[51] Int. Cl.[6] ..... E01C 23/088; E01C 23/12

[52] U.S. Cl. ..... 299/1.5; 299/39.2; 299/39.6; 367/96; 404/84.5

[58] Field of Search ..... 299/1.05, 1.5, 299/39, 39.2, 39.6; 172/4, 5; 404/84.05, 84.5; 364/427.07; 367/96

[56] References Cited

U.S. PATENT DOCUMENTS

| | | | |
|---|---|---|---|
| 3,779,661 | 12/1973 | Godbersen | 404/84.05 X |
| 4,186,968 | 2/1980 | Barton | 299/39 |
| 4,678,236 | 7/1987 | Wirtgen | 299/1.5 |
| 4,723,867 | 2/1988 | Wirtgen | 299/39 X |
| 4,727,686 | 3/1988 | Persson | 299/41 X |
| 4,943,119 | 7/1990 | Zarniko et al. | 299/1.5 |
| 5,022,763 | 6/1991 | Vuagnat | 172/4.5 X |
| 5,309,407 | 5/1994 | Sehr et al. | 404/84.05 X |

FOREIGN PATENT DOCUMENTS

| | | | |
|---|---|---|---|
| 82295/82 | 10/1983 | Australia . | |
| 498411 | 12/1992 | European Pat. Off. . | |
| 2542504 | 4/1977 | Germany | 299/39 |
| 279805 | 11/1990 | Japan | 404/90 |
| 659732 | 2/1932 | United Kingdom . | |
| 368327 | 10/1951 | United Kingdom . | |
| WO92/02334 | 2/1992 | WIPO . | |

OTHER PUBLICATIONS

Soviet Abstract SU-326329—Soviet Inventions Illustrated—Sep., 1972.

*Primary Examiner*—David J. Bagnell
*Attorney, Agent, or Firm*—Foley & Lardner

[57] ABSTRACT

A floor milling machine is provided which comprises a chassis structure supported by front and real ground-engaging wheels respectively and a rotatable milling drum mounted on the chassis structure. The machine is particularly designed for use indoors, and includes a removable waste hopper and a vacuum system to suck up debris and dust created as a floor surface is milled by the drum and to transfer the dust and debris to the waste hopper so that dust is contained within the machine and not released to the surrounding environment. The machine also includes individual height adjustment devices for at least the rear wheels and a control and detection system which can control the height adjustment devices to vary the level and orientation of the milling drum relative to the level of the wheels. The machine can thus be used to take up tiles from a floor surface of, for example a shopping center, or the plane a concrete floor surface to produce a flat, level surface or a sloping surface.

29 Claims, 4 Drawing Sheets

FLOOR MILLING MACHINES

This invention relates to machines which have cutting or milling drums or the like for taking up floor tiles from floor surfaces and for planing or levelling floor surfaces. Such machines will hereinafter be referred to as "floor milling machines", as distinct from concrete grinding machines which have a grinding wheel or other abrasive member for smoothing a concrete surface.

The present invention is particularly concerned with floor milling machines for use inside buildings, such as shopping centers and exhibition halls, where it is desirable to control dust and pollution emissions when old floor tiles are removed and broken up and/or when concrete or like floor surfaces within a building are levelled. Such dust and debris created by ripping up the floor tiles or by planing the concrete is a particular problem in shopping centers with food halls and other retail outlets where a high standard of hygiene is required.

It is therefore desirable to provide a machine which is able to remove floor tiles from a surface and/or to plane a floor surface without releasing or emitting large amounts of dust into the surrounding environment.

A further problem with levelling floors inside buildings is that concrete floors usually incorporate steel reinforcements and, when such a reinforced concrete floor is planed, at least a minimum thickness of concrete should preferably be left between the steel reinforcements and the finished surface of the concrete.

It is also desirable, therefore, to provide a tile removing or concrete levelling machine which can ensure that the finished surface of concrete is a required height above the level of steel reinforcements in the concrete.

It is further desirable to provide a milling machine which is capable of operating on a concrete floor or on a tiled surface with underlying concrete to produce a flat, level surface which can then be readily re-surfaced with a new layer of tiles or the like.

According to one aspect of the invention, there is provided a floor milling machine comprising a chassis structure supported by ground-engaging wheels, rotatable milling means mounted on the chassis structure for rotation about a generally horizontal axis and for engagement with a floor surface to remove material from the floor surface, storage means mounted on the chassis structure to receive material such as dust and debris removed from the floor surface as the milling means passes over and engages the floor surface and means to transfer the material removed from the floor surface from adjacent the milling means to the storage means.

Preferably, the milling means comprises a milling drum contained within a housing and a vacuum system is provided to evacuate dust and debris from the drum housing to the storage means which preferably comprises a removable waste hopper.

In a preferred embodiment, front, side and rear containment boards are provided around the base of the drum housing and a vacuum tube of the vacuum system is provided to suck up dust or debris which escapes from the drum housing under the rear board and transfer it to the storage means.

According to another aspect of the invention there is provided a floor milling machine comprising a chassis structure supported by ground-engaging wheels, rotatable milling means mounted on the chassis structure for rotation about a generally horizontal axis and for engagement with a floor surface to remove material from the surface, height adjustment means to adjust the level of the wheels relative to the milling means, and control means to control the adjustment means.

Preferably, the milling means is located in the vicinity of a pair of rear ground-engaging wheels and the level of each rear wheel is individually adjustable relative to the height of the chassis structure and to the milling means mounted thereon, so that the level and orientation of the milling means relative to the floor beneath the machine is adjustable.

The machine preferably includes detection means to sense information about the floor surface beneath the machine and/or to sense information about the level of the chassis structure relative either to the floor surface or to a reference level. The control means may, for example, comprise an electronic control system having optical detection means, such as photocells or at least one laser detector, mounted on the chassis structure for detecting a beam of light, such a laser beam, which sets the reference level. Alternatively or additionally, the detection means may comprise an ultrasonic system having at least one ultrasonic emitter and receiver mounted on the chassis structure for detecting information on the level of the floor beneath the machine relative to the level of the chassis structure. This information may be compared with a reference level and the comparison used to control the height adjustment means for the wheels.

Further, the detection and control means may also include an ultrasonic system to detect information about the location of steel reinforcements within a concrete floor and provide control signals to the height adjustment means for the wheels in response to that information.

Preferably, the control means is programmable and is arranged to control automatically the level and orientation of the milling means relative to the floor by controlling individual adjustment devices for the wheels of the machine.

The programmable control means is preferably arranged to control the level of the milling means relative to the wheels as the machine moves across a floor surface so that the milling means removes material from the floor surface in accordance with a preprogrammed milling profile. For example, the machine may be programmed to take up tiles from a floor surface, or to plane a floor surface, e.g. a concrete floor, beneath the machine. By using individual adjustment devices for each wheel and a sophisticated control and detection system, the machine may be programmed to plane and level a surface to within 1 mm of accuracy, and the machine can also be used to plane a floor surface to produce a graded or sloping surface.

An embodiment of the present invention will now be described, by way of example only, with reference to the accompanying drawing in which.

Figure 1:
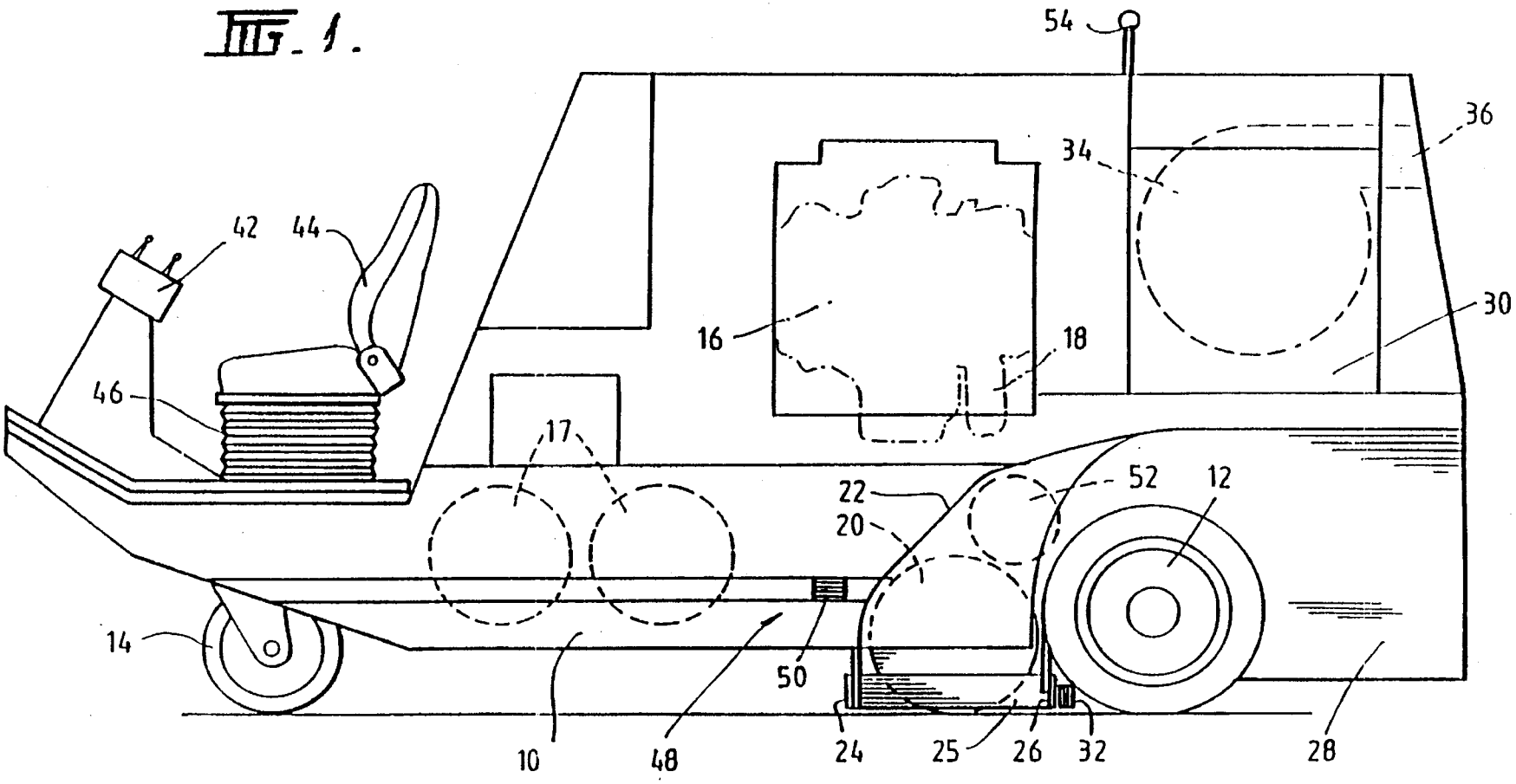
FIG. 1 is a schematic side view of a floor milling machine in accordance with the invention.
Figure 2:
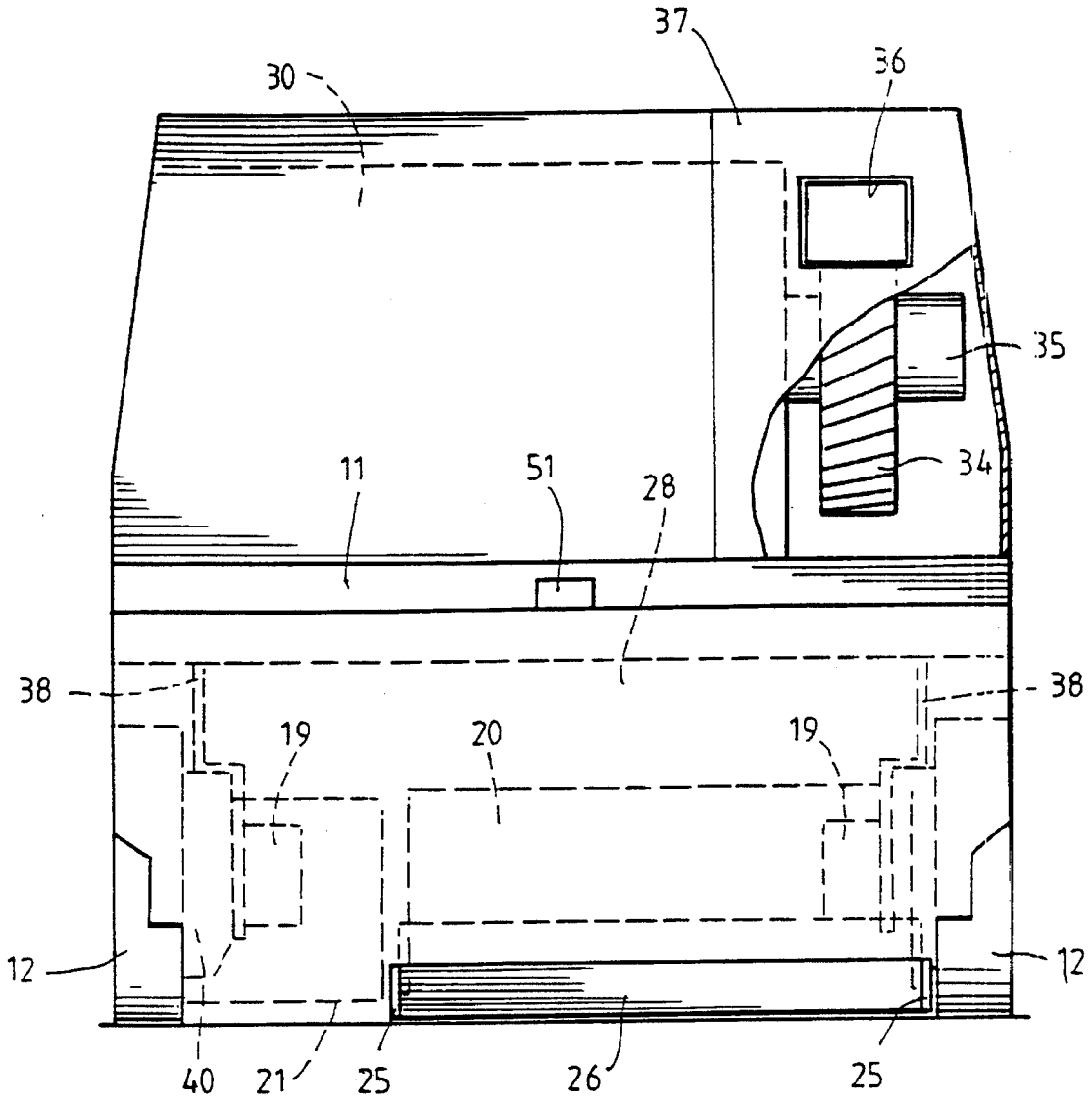
FIG. 2 is a schematic rear view of the machine shown in FIG. 1.

The floor milling machine shown in FIGS. 1 and 2 comprises a chassis structure 10 supported by a pair of ground-engaging rear wheels 12 and a steerable front wheel 14, an engine 16 mounted on the chassis structure 10, and milling means in the form of a rotatable milling drum 20.

The milling machine is designed particularly for use indoors and, consequently, the engine 16 preferably comprises a petrol engine fueled by liquid petroleum gas (LPG) from LPG gas cylinders 17 so that pollution emissions from the engine are minimized. The machine preferably includes an hydraulic system with hydraulic pumps 18 charged by the engine 16 and hydraulic drive motors 19 and 21 for driving the rear wheels 12 and the milling drum 20 respectively. It will, however, be appreciated that any other convenient drive system may be utilized to drive the wheels and to rotate the milling drum.

The milling drum 20 is mounted on the chassis structure 10 for rotation about an axis extending substantially parallel to and located forwardly of the axis of rotation of the rear wheels 12. The milling drum 20, which is independently driven by hydraulic drum drive 21, is rotatable at speeds up to 300 rpm. The milling drum 20 is conveniently similar to the type of drum used on conventional road planing machines having a number of cutting or milling members or teeth on its periphery which, when the drum is rotated in use, is adapted to engage with a floor surface beneath the machine.

The floor milling machine of the invention differs from conventional road planing machines in that it has been specifically designed for use indoors to rip up tiles from, and to plane, floors in buildings such as shopping centers, exhibition halls or the like. Thus, the milling drum 20 is contained in a drum housing 22, front, side and rear mould boards 24, 25 and 26 respectively are provided around the base of the drum housing 22, a removable waste hopper 28 is provided at the rear of the machine to receive debris and dust created by engagement of the milling drum 20 with the floor surface, and a vacuum system is provided to suck up debris and dust from the vicinity of the milling drum 20 and transfer it to the waste hopper 28.

The vacuum system as shown in FIGS. 1 and 2 essentially comprises a vacuum box 30 mounted at the rear of the machine above the waste hopper 28, suction means (not shown) to evacuate dust from the drum housing 22, a vacuum tube 32 disposed behind the rear mould board 26 and an exhaust system comprising a vacuum exhaust fan 34, a motor for driving the exhaust fan 35 and an exhaust outlet 36. The vacuum system is preferably self cleaning with a clean air manifold 37 and discharges dust and debris sucked up from the vicinity of the milling drum 20 into the waste hopper 28.

As shown in FIG. 2 the height of each rear wheel 12 is individually adjustable relative to the chassis structure 10 by means of a height adjustment device comprising an adjustment lever 38 operated by an hydraulic cylinder (not shown). Each adjustment lever 38 is connected to a respective rear wheel hub 40 and movement of each lever 38 is controlled electrically from a control console 42 disposed at the forward end of the milling machine in front of a seat 44 for the machine operator. The seat 44 preferably includes a shock absorbing base 46 and is movable as a unit with the control console 42 transversely of the machine. Such side-to-side movement enables the operator to have a good view down either side of the machine, as required.

In use of the machine, the operator may use the control console 42 to control the height of the rear wheels 12 relative to the chassis structure 10 and thus control the level and orientation of the milling drum 20 relative to the floor. In a preferred embodiment of the invention, however, the control console 42 is preferably programmed to control automatically the rear wheel height adjustment devices 38 and therefore the level of the milling means relative to the floor surface in accordance with a preprogrammed milling profile and in response to signals from an optical guide control system and an ultrasonic detection system 48.

The optical guide control system of the machine is preferably a laser system of the type which uses a laser receiver 54 mounted on the machine at a location substantially above the rear wheels 12 to detect the presence or absence of a laser beam from a remote source which acts as a reference level that can be used to guide the machine to move in a predetermined direction and/or to maintain the milling drum at a constant level relative to the laser beam as the machine moves across the floor whereby the milling drum may be used either to remove bumps from the floor surface above a certain horizontal level or to plane a uniform amount of material from the floor surface down to a required depth.

The machine also includes an ultrasonic system with ultrasonic emitters and detectors 50 mounted on each side of the chassis in the vicinity of the milling drum 20 to detect the height of the machine chassis above the floor surface which can then be compared with a predetermined reference level to produce control signals to control the level of the wheels relative to the milling drum. The reference level may be, for instance, the level of the existing floor surface when it is desired to plane a uniform amount of material off the floor surface. Alternatively, the reference level may be provided by a string line or a laser beam which enables the machine to plane a concrete surface to produce a flat, level surface or a graded or sloping surface.

The laser guide control system and the ultrasonic detection system 48 provide level control signals to the control console 42 for controlling the height of each rear wheel.

The use of individual height adjustment devices for the rear wheels 12 at least of the machine in conjunction with the sophisticated laser control system and ultrasonic detection system enable the machine to plane and level a concrete surface to within 1 mm of accuracy. Also, the machine may be used to plane graded or sloping surfaces with the individually controllable height adjustment devices being controlled by a slope sensor 51 mounted centrally on a transverse member 11 of the chassis 10.

The ultrasonic detection and control system 48 may also detect information about the depth of steel reinforcements below the surface of a concrete floor with the information being used to ensure the machine leaves sufficient concrete above the reinforcements when planing the surface.

In use, the operator controls the hydraulic drive motor 19 and the hydraulic drum drive 21 respectively to move the machine forwardly and to rotate the drum after programming the control system for the required use and adjusting the height and orientation of the milling drum 20 relative to the wheels 12 so that the drum engages with the floor beneath the machine. For a tiled surface, the milling members or teeth of the rotating drum 20 engage with tiles to rip up the tiles from the floor and the tiles are subsequently smashed and discharged into the waste hopper 28. Optionally, a debris "flipper" shaft 52 may be provided above and slightly rearwardly of the milling drum 20 to assist in smashing up the tiles and flipping them into the hopper 28. Any parts of the smashed tiles or dust left within the drum housing 22 will be sucked up by the suction means of the vacuum system and discharged into the waste hopper 28. The front, side and rear mould boards 24, 25 and 26 assist in preventing dust and debris from escaping from the drum housing 22, and dust escaping beneath the rear mould board 26 will be sucked up by the vacuum tube 38 and also discharged into the waste hopper 28.

During operation, the waste hopper 28 is preferably sealed to the rest of the machine housing, but after use it may be removed, e.g. by a fork lift, and either emptied or replaced by an empty hopper for subsequent re-use of the machine.

Whilst the operation of the machine has been described above in relation to a tiled floor, the machine may also be used to plane either the concrete surface exposed after removing tiles from a floor, or to plane an existing concrete floor surface to produce a flat level surface. Also, the machine may be used to plane graded or sloping surfaces either with the machine moving up or down the slope, in which case the angle of slope may be determined by the angle of a reference line, e.g. a guiding laser beam, relative to the horizontal, or with the machine moving across a slope wherein the individually controllable height adjustment devices allow slopes of up to 20% to be planed by the machine. Further, the machine is particularly suitable for use inside buildings such as shopping centers and the like since the enclosed milling drum, the mould boards and vacuum system prevent large quantities of dust and debris from passing into the surrounding environment.

Figure 3:
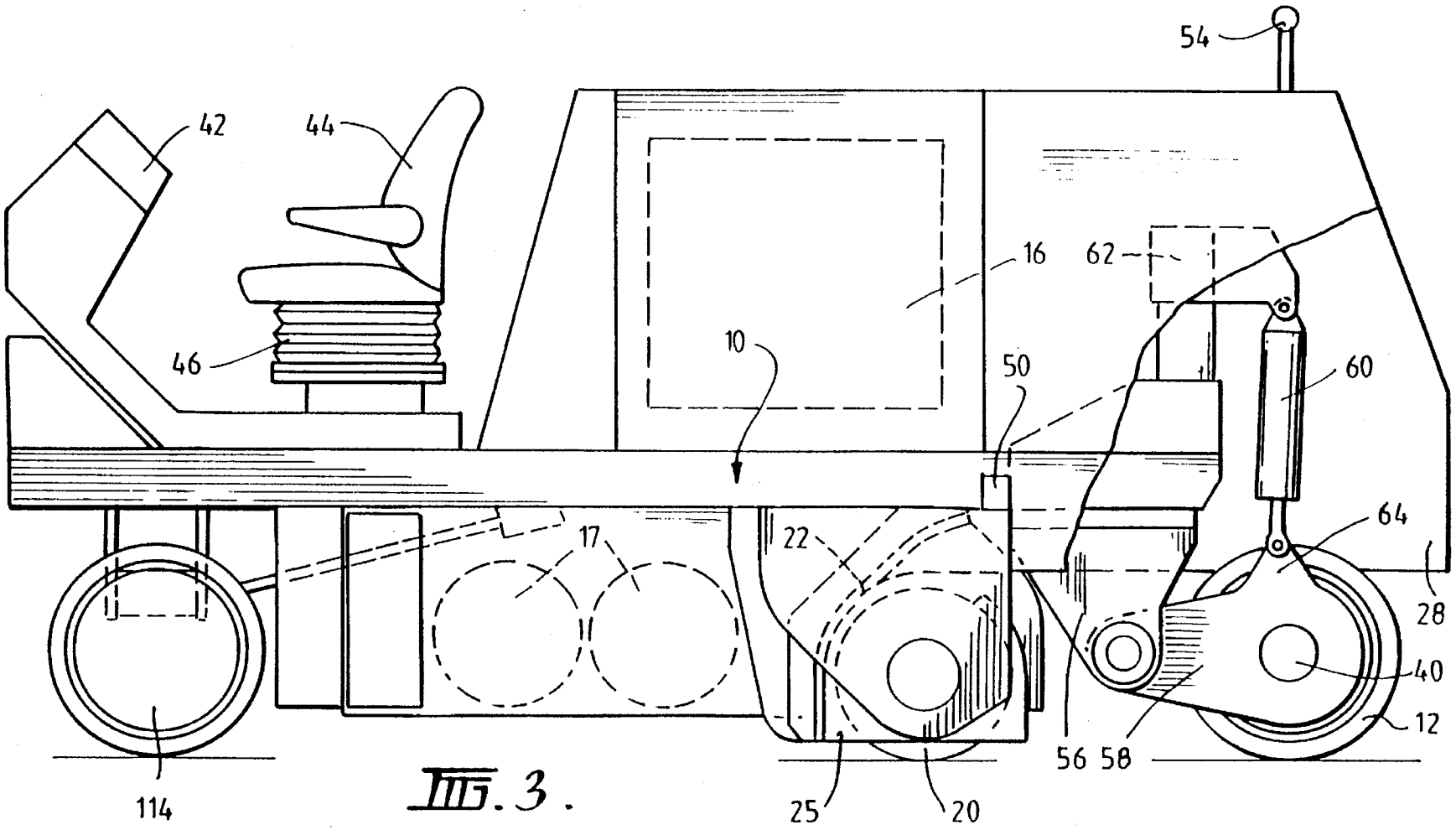
FIG. 3 is a schematic side view of a modified floor milling machine similar to the machine of FIG. 1.

Referring to FIG. 3 of the drawings there is shown a modified floor milling machine that is very similar to the machine of FIGS. 1 and 2 and corresponding reference numerals have been applied to corresponding parts.

Figure 4:
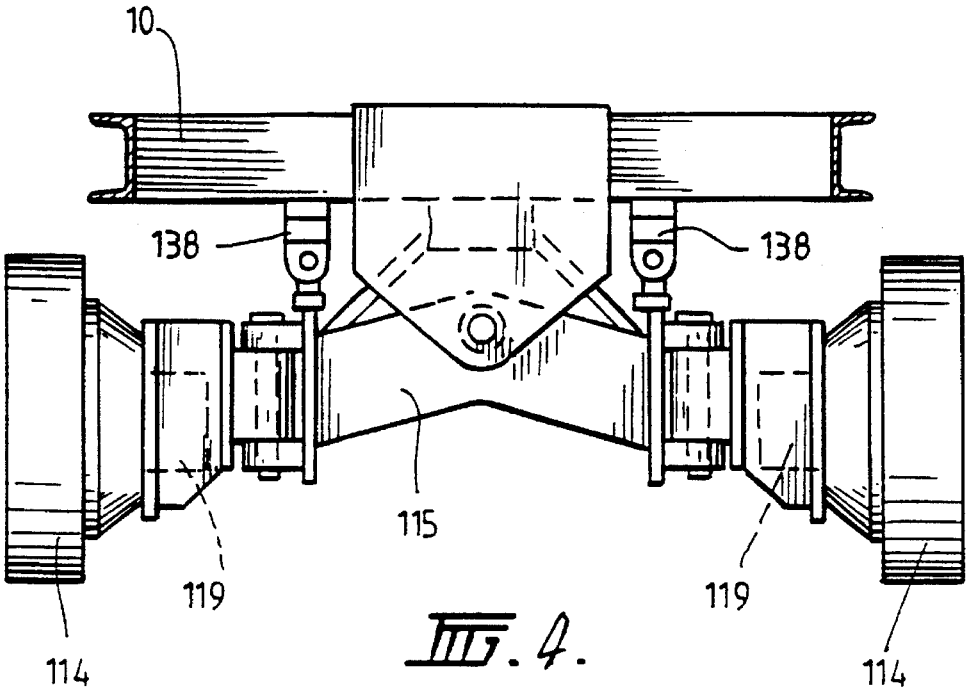
FIG. 4 is a front view of the undercarriage of the machine of FIG. 3.
Figure 5:
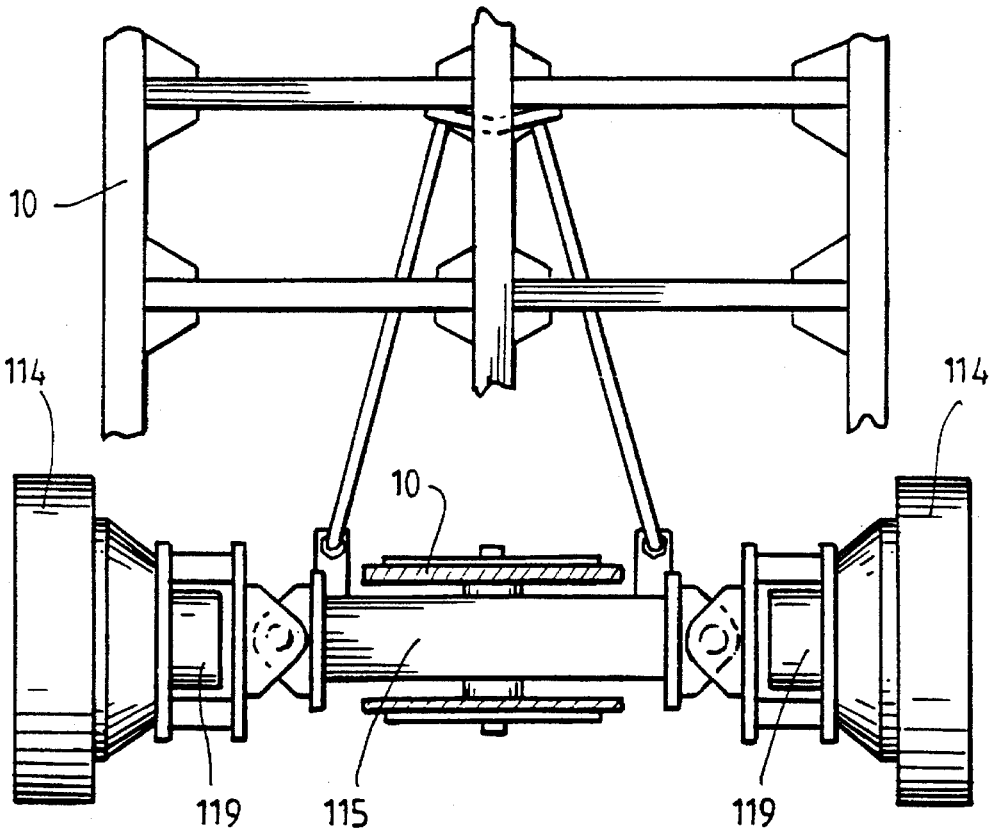
FIG. 5 is a plan view of the front section of the undercarriage of the machine of FIG. 3.

The machine of FIG. 3 differs from the machine of FIG. 1 primarily in the nature of the height adjustment devices for the rear wheels and the front wheel arrangement which is illustrated in greater detail in FIGS. 4 and 5.

As shown in FIG. 3, the hub 40 of each rear wheel 12 is pivotally connected to a downwardly depending member 56 of the chassis structure 10 by a longitudinally extending pivotal member 58 so that each rear wheel 12 can move upwards or downwards relative to the chassis structure 10 independently under the control of a height adjustment device 60. The height adjustment device 60 for each rear wheel 12 comprises a substantially vertically extending telescoping hydraulic cylinder assembly which is connected at its upper end to an upper part 62 of the chassis structure 10 and at its lower end to a lug 64 on pivotal member 58 substantially above the centre of the rear wheel 12. Each height adjustment device 60 controls the height of each rear wheel 12 and thus the level and orientation of the milling drum 20 relative to the rear wheels under the control of console 42 in accordance with the preprogrammed milling profile and in response to signals from the laser detector 54 and from the ultrasonic system 48, 50 in the same manner as described with reference to FIGS. 1 and 2.

As shown particularly in FIGS. 4 and 5, the machine of FIG. 3 also differs from that of FIG. 1 in that it has two front wheels 114 instead of a single front wheel.

Each front wheel 114 is independently driven by its own hydraulic motor 119. The front wheels 114 are pivotally connected to a central wishbone member 115 for relative movement about a vertical axis, and the wishbone member 115 is in turn pivotally connected to the chassis structure 10 for relative movement about a horizontal axis. The front wheel arrangement as shown in FIGS. 4 and 5 allows the machine to be steered easily and to move over uneven floor surfaces without affecting the level of the rear wheels 12 relative to the milling drum 20. Further, individual height adjustment devices 138 may be provided for each front wheel 114 if so desired.

It will be appreciated that various modifications or alterations may be made to the milling machines described herein without departing from the scope or spirit of the invention. For instance, the front wheel or wheels may also be provided with height adjustment devices, the form of the milling means may be changed for different applications, and the detection and control system may be changed or modified as required.

I claim:

1. A floor milling machine for taking up floor tiles from a tiled floor surface inside a building comprising:

a chassis structure supported by a plurality of ground-engaging wheels;

rotatable milling means mounted on the chassis structure for engagement with a tiled floor surface to take up tiles from the floor surface;

height adjustment means to adjust the level of one or more of the ground-engaging wheels relative to the milling means;

control means for controlling the height adjustment means; and ultrasonic detection means to sense information about the tiled floor surface beneath the machine;

the control means being adapted to control the height adjustment means in response to signals from the detection means, whereby a layer of tiles of a particular thickness can be removed by the milling means.

2. A floor milling machine according to claim 1 wherein the detection means comprises an ultrasonic system including at least one ultrasonic emitter and receiver.

3. A floor milling machine according to claim 1 wherein the detection means senses information on the level of the floor surface beneath the machine relative to the level of the chassis structure and the control means compares said information with a reference level and controls the height adjustment means for the wheels in response to said comparison.

4. A floor milling machine according to claim 1 wherein the milling means is also adapted to plane a floor surface.

5. A floor milling machine according to claim 4 wherein the ultrasonic detection means further comprises means for sensing information about the location of steel reinforcements within a concrete floor.

6. A floor milling machine according to claim 4 wherein the control means includes an optical sensor mounted on the chassis structure to sense information about the level of the chassis structure relative to a reference level whereby the control means controls the height adjustment means for the wheels in response to said information about the level of the chassis structure.

7. A floor milling machine according to claim 6 wherein the reference level is set by a laser beam and said optical sensor comprises a laser receiver mounted on the chassis structure.

8. A floor milling machine according to claim 1 wherein the control means is programmable and is arranged to control the level of the milling means relative to the wheels as the machine moves across a floor surface so that the milling means removes material from the floor surface in accordance with one of a plurality of preprogrammed milling profiles.

9. A floor milling machine according to claim 8 wherein the control means is programmable to control the milling means to take up a layer of tiles of a predetermined thickness from a floor surface without substantially affecting the underlying floor surface.

10. A floor milling machine according to claim 9 wherein the control means is programmable to control the milling means to plane a concrete floor surface beneath the machine.

11. A floor milling machine according to claim 9 wherein the control means is programmable to control the milling means to grade a floor surface beneath the machine.

12. A floor milling machine according to claim 1 wherein the milling means comprises a milling drum rotatable about a generally horizontal axis and having a plurality of milling teeth on its periphery.

13. A floor milling machine according to claim 1 wherein the milling means is located in the vicinity of a pari of said ground-engaging wheels and the level of each of said pair of wheels is individually adjustable relative to the chassis structure and to the milling means mounted thereon.

14. A floor milling machine according to claim 13 wherein said pair of ground-engaging wheels constitute rear wheels of the vehicle, and an individual hydraulically-operable adjustment device controlled by the control means is provided for adjusting the level of each rear wheel relative to the chassis structure.

15. A floor milling machine according to claim 13 wherein the machine has one or more front wheels, and the level of each front wheel relative to the chassis structure is adjustable under the control of the control means.

16. A floor milling machine according to claim 1 further including storage means mounted on the chassis structure to receive material, such as dust and debris, removed from the floor surface as the milling means passes over and engages the floor surface, and means to transfer the material removed from the floor surface from adjacent the milling means to the storage means.

17. A floor milling machine according to claim 16 wherein the milling means comprises a milling drum which has a plurality of milling teeth on its periphery.

18. A floor milling machine according to claim 17 wherein the milling drum is contained within a drum housing, and a vacuum system is provided to transfer the material removed from the floor surface from the drum housing to the storage means.

19. A floor milling machine according to claim 18 wherein dust containment boards are provided around the base of the drum housing.

20. A floor milling machine according to claim 19 wherein a vacuum tube of the vacuum system is provided to suck up dust and debris which escapes from the base of the drum housing and to transfer said dust or debris to the storage means.

21. A floor milling machine according to claims 16 wherein the storage means comprises a removable waste hopper.

22. A floor milling machine comprising:

a chassis structure supported by a plurality of ground-engaging wheels, rotatable milling means mounted on the chassis structure and engageable with a floor surface to remove material from the floor surface, height adjustment means to adjust the level of one or more of the wheels relative to the milling means, ultrasonic detection means to sense information about the floor surface beneath the machine, and control means to control the height adjustment means in response to signals from the detection means, wherein said ultrasonic detection means includes means for sensing information about the location of steel reinforcements within a concrete floor.

23. A floor milling machine according to claim 22 wherein the detection means comprises an ultrasonic system including at least one ultrasonic emitter and receiver.

24. A floor milling machine comprising:

a chassis structure supported by a plurality of ground-engaging wheels, rotatable milling means mounted on the chassis structure and engageable with a floor surface to remove material from the floor surface, height adjustment means to adjust the level of one or more of the wheels relative to the milling means, detection means to sense information about the floor surface beneath the machine, control means to control the detection means in response to signals from the detection means, storage means mounted on the chassis structure to receive material such as dust and debris removed from the floor surface as the milling means passes over and engages the floor surface, and vacuum means to transfer the material removed from the floor surface from adjacent the milling means to the storage means.

25. A floor milling machine according to claim 24 wherein the milling means comprises a milling drum contained within a drum housing and the vacuum means is arranged to transfer material removed from the floor surface from the drum housing to the storage means.

26. A floor milling machine according to claim 24 wherein the milling drum is rotatable about a generally horizontal axis and has a plurality of milling teeth on its periphery.

27. A floor milling machine according to claim 25 wherein dust containment boards are provided around the base of the drum housing.

28. A floor milling machine according to claim 27 wherein a vacuum tube of the vacuum means is provided to suck up dust and debris which escapes from the base of the drum housing and to transfer said dust and debris to the storage means.

29. A floor milling machine according to claim 24 wherein the storage means comprises a removable waste hopper.

* * * * *